US009022387B2

(12) United States Patent
Lee

(10) Patent No.: US 9,022,387 B2
(45) Date of Patent: May 5, 2015

(54) PRINT-MEDIUM STORING UNIT, PRINT-MEDIUM STORING APPARATUS AND IMAGE FORMING APPARATUS EMPLOYING THE SAME

(71) Applicant: SAMSUNG Electronics Co., Ltd., Suwon-si, Gyeonggi-do (KR)

(72) Inventor: Joo-heon Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 14/086,058

(22) Filed: Nov. 21, 2013

(65) Prior Publication Data

US 2014/0077439 A1 Mar. 20, 2014

Related U.S. Application Data

(63) Continuation of application No. 12/620,719, filed on Nov. 18, 2009, now Pat. No. 8,620,204.

(30) Foreign Application Priority Data

Jan. 8, 2009 (KR) ..... 10-2009-0001568

(51) Int. Cl.
*B65H 29/00* (2006.01)
*B65H 5/26* (2006.01)
(Continued)

(52) U.S. Cl.
CPC ..... *B65H 5/26* (2013.01); *B65H 29/14* (2013.01); *B65H 31/24* (2013.01); *B65H 1/04* (2013.01); *B65H 5/068* (2013.01);

(58) Field of Classification Search
CPC ..... B65H 2403/00; B65H 2403/40; B65H 2403/50; B65H 2403/70; B65H 2403/72; B65H 2403/721; B65H 2403/722; B65H 2403/723; B65H 29/00; B65H 29/20; B65H 29/22; B65H 31/00; B65H 31/24
USPC ..... 271/279, 288, 298, 9.11
See application file for complete search history.

(56) References Cited

U.S. PATENT DOCUMENTS 4,239,569 A 12/1980 Harvey
4,789,259 A 12/1988 Katayanagi
(Continued)

FOREIGN PATENT DOCUMENTS

JP 3783389 6/2006

OTHER PUBLICATIONS

Extended European Search Report dated Dec. 7, 2012 issued in EP Application No. 09180571.3.
(Continued)

*Primary Examiner* — Prasad Gokhale
(74) *Attorney, Agent, or Firm* — Staas & Halsey LLP

(57) ABSTRACT

A print-medium storing unit, a print-medium storing apparatus including the same, and an image forming apparatus including the same which are provided in a power transmission mechanism, print-medium storing apparatus which is installed on a discharge path of a print-medium in an image forming apparatus, includes a plurality of storing units which is arranged with multi-layers, and a controller which controls to drive a feeding unit of another storing unit arranged between the storing unit through which the print-medium is to be discharged and the image forming apparatus, by a driving source of the storing unit through which the print-medium is to be discharged.

7 Claims, 8 Drawing Sheets

(51) Int. Cl.

| | |
|---|---|
| ***B65H 29/14*** | (2006.01) |
| ***B65H 31/24*** | (2006.01) |
| ***B65H 1/04*** | (2006.01) |
| ***B65H 5/06*** | (2006.01) |

(52) U.S. Cl.
CPC ..... *B65H 2403/42* (2013.01); *B65H 2403/72* (2013.01); *B65H 2405/332* (2013.01); *B65H 2513/42* (2013.01); *B65H 2801/06* (2013.01)

(56) References Cited

U.S. PATENT DOCUMENTS

| | | | | |
|---|---|---|---|---|
| 4,849,790 | A * | 7/1989 | Ito | 399/367 |
| 5,810,353 | A * | 9/1998 | Baskette et al. | 271/305 |
| 6,308,952 | B1 * | 10/2001 | Takagi et al. | 271/297 |
| 6,443,449 | B1 | 9/2002 | Takagi et al. | |
| 6,487,379 | B2 * | 11/2002 | Sato | 399/16 |
| 8,276,912 | B2 * | 10/2012 | Yang | 271/303 |

OTHER PUBLICATIONS

United States Non-Final Office Action dated Jan. 12, 2012 issued in U.S. Appl. No. 12/620,719.

United States Final Office Action dated May 1, 2012 issued in U.S. Appl. No. 12/620,719.

United States Advisory Action dated Jul. 10, 2012 issued in U.S. Appl. No. 12/620,719.

United States Non-Final Office Action dated Oct. 11, 2012 issued in U.S. Appl. No. 12/620,719.

United States Final Office Action dated Mar. 7, 2013 issued in U.S. Appl. No. 12/620,719.

United States Notice of Allowance dated Aug. 21, 2013 issued in U.S. Appl. No. 12/620,719.

Korean Office Action dated Mar. 3, 2015 from Korean Patent Application No. 10-2009-0001568, 13 pages.

* cited by examiner

PRINT-MEDIUM STORING UNIT, PRINT-MEDIUM STORING APPARATUS AND IMAGE FORMING APPARATUS EMPLOYING THE SAME

CROSS-REFERENCE TO RELATED APPLICATIONS

This application is a Continuation Application of prior application Ser. No. 12/620,719, filed on Nov. 18, 2009 in the United States Patent and Trademark Office, which claims priority under 35 USC §119 from Korean Patent Application No. 10-2009-0001568, filed on Jan. 8, 2009 in the Korean Intellectual Property Office, the disclosure of which is incorporated herein by reference.

BACKGROUND

1. Field of the General Inventive Concept

Apparatuses and methods consistent with the present general inventive concept relate to a print-medium storing unit, a print-medium storing apparatus including the same, and an image forming apparatus including the same which are provided in a power transmission mechanism.

2. Description of the Related Art

A print-medium storing unit is typically arranged in an image forming apparatus such as a printer, a copy machine, a facsimile or a multifunctional device, and stores a print-medium discharged from the image forming apparatus. The print-medium storing unit includes a feeding roller which feeds a print-medium, a discharging roller which discharges the fed print-medium to a tray, and a driving source which drives the feeding roller and the discharging roller.

A print-medium storing apparatus includes a plurality of print-medium storing units which are arranged with multi-layers. In a conventional print-medium storing apparatus, when a print-medium is discharged to an upper-layered print-medium storing unit, a driving source of the upper-layered storing unit through which the print-medium is discharged and a driving source of a lower-layered storing unit are driven together to rotate a feeding roller and a discharging roller which is provided in each storing unit.

That is, in the conventional storing apparatus, the driving source of the lower-layered storing unit other than the storing unit through which the print-medium is discharged is driven to rotate the feeding roller and the discharging roller arranged in the lower-layered storing unit, thereby increasing power consumption and noises.

SUMMARY

The present general inventive concept provides a print-medium storing unit, a print-medium storing apparatus including the same and an image forming apparatus including the same which can drive a feeding unit of a lower-layered storing unit by a driving force of a storing unit through which a print-medium is discharged.

Additional aspects of the present general inventive concept will be set forth in part in the description which follows and, in part, will be obvious from the description, or may be learned by practice of the present general inventive concept.

The foregoing and/or other aspects and utilities of the present general inventive concept can be achieved by providing a print-medium storing apparatus which is installed on a discharge path of a print-medium in an image forming apparatus, including a plurality of storing units which is arranged with multi-layers, and a controller which to control the drive of a feeding unit of a storing unit arranged between another storing unit through which the print-medium is to be discharged and the image forming apparatus, by a driving source of the another storing unit through which the print-medium is to be discharged.

The plurality of storing units may include a main storing unit which is driven by a main driving source of the image forming apparatus, and at least two auxiliary storing units which are arranged with multi-layers above the main storing unit.

The at least two auxiliary storing units respectively may include, a driving source which is controlled by the controller, a feeding unit which feeds the print-medium, a power transmission unit which transmits a driving force of the driving source to the feeding unit, and a tray on which the print-medium fed through the feeding unit is stored.

The feeding unit may include, a feeding roller which feeds the print-medium, and a discharging roller which discharges the print-medium fed through the feeding roller to the tray.

The power transmission unit may include, a plurality of gears which transmit the driving force of the driving source, a first power switching unit which transmits the driving force of the driving source connected thereto to the plurality of gears and the feeding unit, and prevents the driving force of the driving source of the storing unit from being transmitted to the discharging roller connected thereto, and a second power switching unit which transmits a driving force of the driving source of an upper-layered storing unit to the feeding roller of a lower-layered storing unit, and prevents the driving force of the lower-layered storing unit from being transmitted to the upper-layered storing unit.

Each auxiliary storing unit may include, a sensor unit which senses the amount of the print-mediums stored on the tray, and a selector through which a tray on which the print-medium is to be stored is selected according to the amount of the print-mediums sensed by the sensor unit or user selection.

The foregoing and/or other aspects and utilities of the present general inventive concept may also be achieved by providing a print-medium storing unit, including: a tray on which a print-medium is stored, a driving source which provides a driving force, a feeding unit which includes a feeding roller which feeds the print-medium, and a discharging roller which discharges the print-medium fed through the feeding roller to the tray, and a power transmission unit which transmits the driving force of the driving source to the feeding unit including, a first power switching unit which transmits the driving force of the driving source connected thereto to the feeding unit, and prevents the driving force of a driving source of another storing unit from being transmitted to the discharging roller connected thereto, and a second power switching unit which transmits a driving force of the driving source of the upper-layered storing unit to the feeding roller of the lower-layered storing unit, and prevents the driving force of the lower-layered storing unit from being transmitted to the upper-layered storing unit.

The print-medium storing unit may include, a sensor unit which senses the amount of the print-mediums stored on the tray, and a selector through which a tray on which the print-medium is to be stored is selected according to the amount of the print-medium sensed by the sensor unit or user selection.

The foregoing and/or other aspects and utilities of the present general inventive concept may also be achieved by providing an image forming apparatus including print-medium supply unit which supplies a print-medium, a developing unit which forms an image with a toner, a light scanning unit which scans light to the developing unit to form an electrostatic latent image, a transfer unit which transfers the image formed on the developing unit onto the print-medium, a fusing unit which fuses the image on the print-medium, a plurality of storing units which is arranged with multi-layers on a discharge path of the print-medium, and a controller to control the drive of a feeding unit of a storing unit disposed between another storing unit through which the print-medium is to be discharged and the fusing unit, by a driving source of the another storing unit through which the print-medium is to be discharged.

The plurality of storing units may include, a main storing unit which is driven by a main driving source of the image forming apparatus, and at least two auxiliary storing units which is installed with multi-layers above the main storing unit.

The at least two auxiliary storing units respectively may include, a driving source which is controlled by the controller, a feeding unit which feeds the print-medium discharged from the fusing unit, a power transmission unit which transmits a driving force of the driving source to the feeding unit, and a tray on which the print-medium fed through the feeding unit is stored.

The feeding unit may include, a feeding roller which feeds the print-medium, and a discharging roller which discharges the print-medium fed through the feeding roller to the tray.

The power transmission unit may include, a plurality of gears which transmit the driving force of the driving source, a first power switching unit which transmits the driving force of the driving source connected thereto to the plurality of gears and the feeding unit, and prevents the driving force of the driving source of the storing unit from being transmitted to the discharging roller connected thereto, and a second power switching unit which transmits a driving force of the driving source of an upper-layered storing unit to the feeding roller of a lower-layered storing unit, and prevents the driving force of the lower-layered storing unit from being transmitted to the upper-layered storing unit.

The auxiliary storing units respectively may include, a sensor unit which senses the amount of the print-mediums stored on the tray, and a selector through which a tray on which the print-medium is to be stored is selected according to the amount of the print-mediums sensed by the sensor or user selection.

The foregoing and/or other aspects and utilities of the present general inventive concept may also be achieved by providing a print medium storing apparatus including a plurality of storing units installed on a discharge path of a print-medium in an image forming apparatus, including a first storing unit comprising a housing that includes a first storage area and discharges the print-medium along a print path, a second storing unit located above the first storing unit including a second housing disposed along the print path, a third storing unit located above the second storing unit and including a third housing disposed along the print path, and a controller to control a power transmission unit to transfer torque to feeding rollers of the second and third storing units, and to discharging rollers of the third feeding unit and prevent torque from being transmitted to the discharging rollers of the second storage unit when a print medium is discharged into a storage area of the third storage unit.

The foregoing and/or other aspects and utilities of the present general inventive concept may also be achieved by providing an image forming apparatus including a print-medium supply unit which supplies a print-medium, a developing unit which forms an image with a toner, a light scanning unit which scans light to the developing unit to form an electrostatic latent image, a transfer unit which transfers the image formed on the developing unit onto the print-medium, a fusing unit which fuses the image on the print-medium, a first storing unit comprising a housing that includes a first storage area and discharges the print-medium along a print path, a second storing unit located above the first storing unit including a second housing disposed along the print path, a third storing unit located above the second storing unit and including a third housing disposed along the print path; and a controller to control the drive of a feeding unit of a storing unit disposed between another storing unit through which the print-medium is to be discharged and the fusing unit, by controlling a driving source of the another storing unit through which the print-medium is to be discharged.

The foregoing and/or other aspects and utilities of the present general inventive concept may also be achieved by providing a method for discharging a print-medium into a storing unit of an image forming apparatus, the method including feeding a print medium through first, second and third feeding rollers of first, second and third feeding units, transmitting a torque from a power transmission unit to the second and third feeding rollers of the second and third feeding units, and to discharging rollers of the third feeding unit, and preventing torque from being transmitted to second discharging rollers of the second feeding unit when the print medium is discharged into a storage area adjacent the third feeding unit.

Transmitting a torque to the second feeding rollers may include driving the second feeding rollers by a driving force of a driving source of a second power transmission unit separate from a first power transmission unit adjacent the second feeding rollers.

The foregoing and/or other aspects and utilities of the present general inventive concept may also be achieved by proving an image forming apparatus with a plurality of storing units, including a main storing unit formed in the an image forming apparatus, first and second auxiliary storing units above the main storing unit comprising first and second power transmission units and first and second feeding rollers, the first power transmission unit being arranged to prevent torque such that discharging rollers of the first feeding unit are not rotated, wherein the first feeding rollers of the first auxiliary storing unit are driven by a driving force of a driving source of the second power transmission unit.

A gear unit with a three-layered structure may generate a torque to rotate discharging rollers in the second auxiliary storing unit. The second power transmission unit may transmit torque from the second auxiliary storing unit to the first auxiliary storing unit. Torque of the second power transmission unit may be transmitted to the gear unit and drive the rotation of the second feeding rollers.

The foregoing and/or other aspects and utilities of the present general inventive concept may also be achieved by providing an image forming apparatus having a plurality of storing units, including a main storing unit having a main feeding unit, a first auxiliary storing unit above the main storing unit having a first feeding unit and a first power transmission unit that is driven by a driving force of a first driving source, a second auxiliary storing unit having a second feeding unit a to store a print medium and formed above the first storing unit, a first power transmission unit that is driven by the driving force of the first driving source, and a power switching unit of the first storing unit that prevents torque of the first auxiliary storing unit from being transmitted to the second auxiliary storing unit.

A power source may deliver electric power to the first driving source such that a driving force of the first driving source is transmitted to rotate discharging rollers of the first feeding unit.

A gear unit located in the first storing unit such that torque from the gear unit may drive feeding rollers of the first storing unit and prevent torque from being transmitted to the main storing unit.

The foregoing and/or other aspects and utilities of the present general inventive concept may also be achieved by providing an image forming apparatus including a controller to operate the image forming apparatus, a power source to supply power to feeding rollers of first, second and third feeding units and to be controlled by the controller not to supply power to discharging rollers of the third feeding unit, and a gear unit adjacent the second feeding unit including a gear that may be axially disengaged from adjacent gears along a shaft.

The controller may control the gear to be axially disengaged and re-engaged along the shaft to separate from the adjacent gears and control power distribution within the image forming apparatus.

BRIEF DESCRIPTION OF THE DRAWINGS

The above and/or other features and utilities of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
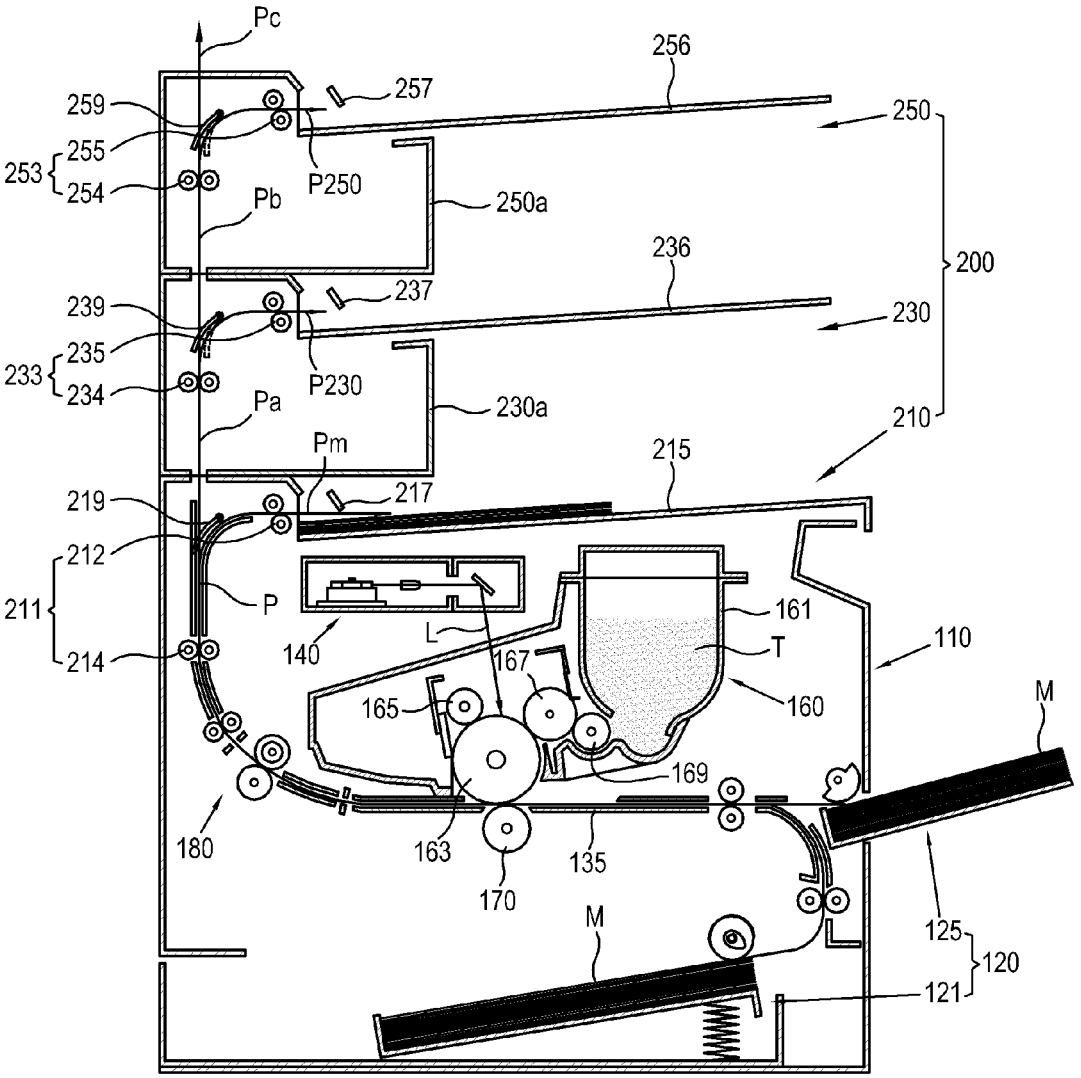
FIG. 1 is a schematic sectional view illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures. Redundant description to different embodiments may be omitted as necessary.

FIG. 1 is a schematic sectional view illustrating an image forming apparatus according to an exemplary embodiment of the present general inventive concept.

Referring to FIG. 1, the image forming apparatus includes a housing 110, a print-medium supply unit 120, a light scanning unit 140 which forms an electrostatic latent image, a developing unit 160, a transfer unit 170 which transfers an image formed on the developing unit 160 onto a print-medium M, a fusing unit 180 which fuses the image transferred onto a print-medium M, and a storing apparatus which stores the printed print-medium M.

The supply unit 120 may supply the print-medium M to the developing unit 160, and may include a first supply unit 121 to supply the print-medium M automatically and a second supply unit 125 to supply the print-medium M manually.

The developing unit 160 may include a toner container 161 in which a toner T is contained, and an image forming unit which forms an image with the toner T provided from the toner container 161. The image forming unit includes a photosensitive body 163 which responds to light L scanned from the light scanning unit 140, an electric charger 165 which electrifies the photosensitive body 163 at a predetermined electric potential, a developing roller 167 which is arranged opposite to the photosensitive body 163 and provides a toner with respect to an area of the photosensitive body 163 on which an electrostatic latent image is formed, and a toner supply roller 169 which supplies the toner T to the developing roller 167.

The light scanning unit 140 may scan light L to the photosensitive body 163 to form an electrostatic latent image on the photosensitive body 163.

The transfer unit 170 may be arranged opposite to the photosensitive body 163 with the print-medium M fed through a feeding path 135 being interposed therebetween, and transfers the toner image formed on the photosensitive body 163 to the supplied print-medium M. The image transferred on the print-medium M may be fused through the fusing unit 180. Then, the printed print-medium M may be discharged to the storing apparatus through a discharge path of the print-medium.

The storing apparatus includes a storing unit 200, and a controller 300 (illustrated in FIG. 3) which controls the storing unit 200. The storing unit 200 may include a plurality of storing units. The storing unit 200 may be arranged to form multi-layers on the discharge path of the print-medium M. The controller 300 may perform control so that a feeding unit of another storing unit arranged between the storing unit through which the print-medium M is discharged and the fusing unit 180 is driven by a driving source of the storing unit through which the print-medium M is discharged.

The plurality of storing units 200 may include a main storing unit 210 and at least two auxiliary storing units 230 and 250 arranged above the main storing unit 210. FIG. 1 illustrates the first and second auxiliary storing units 230 and 250 which are sequentially arranged above the main storing unit 210. In this respect, the first auxiliary storing unit 230 and the second auxiliary storing unit 250 may have the same configuration and may be exchanged each other.

The plurality of storing units 200 may further include a plurality of sub-housing units **230*a* and 250*a* that may enclose the feeding units and provide a platform and support for trays 236 and 256 to store a print-medium. Thus, a print-medium initially travelling along a path P may be directed through a sub-path Pm when being discharged through the first feeding unit 211. The print-medium M may be directed through sub-paths Pa and P230 when being discharged through the second feeding unit 233, and the print-medium M may be directed through sub-paths Pb and P250 when being discharged through the third feeding unit 253**. Also, if additional auxiliary storing units are used, the print-medium M may be directed along sub-path Pc to be discharged through additional feeding units.

Hereinafter, the image forming apparatus according to the present embodiment will be described with reference to the first and second auxiliary storing units 230 and 250.

The main storing unit 210 may be driven by a main driving source (not illustrated) of the image forming apparatus. The main driving source may be disposed inside of the housing 110. The main storing unit 210 may include a first feeding unit 211 which feeds the print-medium M discharged from the fusing unit 180, and a first tray 215 on which the print-medium M fed through the first feeding unit 211 may be stored. The first tray 215 is disposed atop the housing 110 of the main storing unit 210 and under the auxiliary storing unit 230. The auxiliary storing unit 230 is disposed between the main storing unit 210 and the second auxiliary storing unit 250. The first feeding unit 211 includes at least a pair of first feeding rollers 214 which feeds the print-medium M, and first discharging rollers 212 which discharge the print-medium fed through the first feeding rollers 214 to the first tray 215.

Further, the main storing unit 210 may further include a first sensor unit 217 which may sense the amount of the print-mediums stored on the first tray 212, and a first selector 219 through which a tray on which the print-medium is to be stored is selected. The first selector 219 is used to select the tray on which the print-medium is to be stored, based on the amount of the print-mediums stored on the first tray 212 sensed by the first sensor unit 217 or according to user selection. For example, if the amount of the print-mediums on the first tray 212 sensed by the first sensor unit 217 is larger than an allowable, predetermined or preset limit, the controller 300 may control the first selector 219 so that the print-medium M fed through the first feeding roller 214 directs at least a portion of the print-medium M to the auxiliary storing units 230 and 250.

The first sensor unit 217 may be mounted on the housing 110 of the main storing unit 210. The second sensor unit 237 may be mounted on the first sub-housing unit 230*a* and the third sensory unit 257 may be mounted on sub-housing unit 250*a*.

The first and second auxiliary storing units 230 and 250 are detachably arranged above the main storing unit 210. The first and second auxiliary storing units 230 and 250 are respectively driven by power supplied from a main body of the image forming apparatus.

Figure 2:
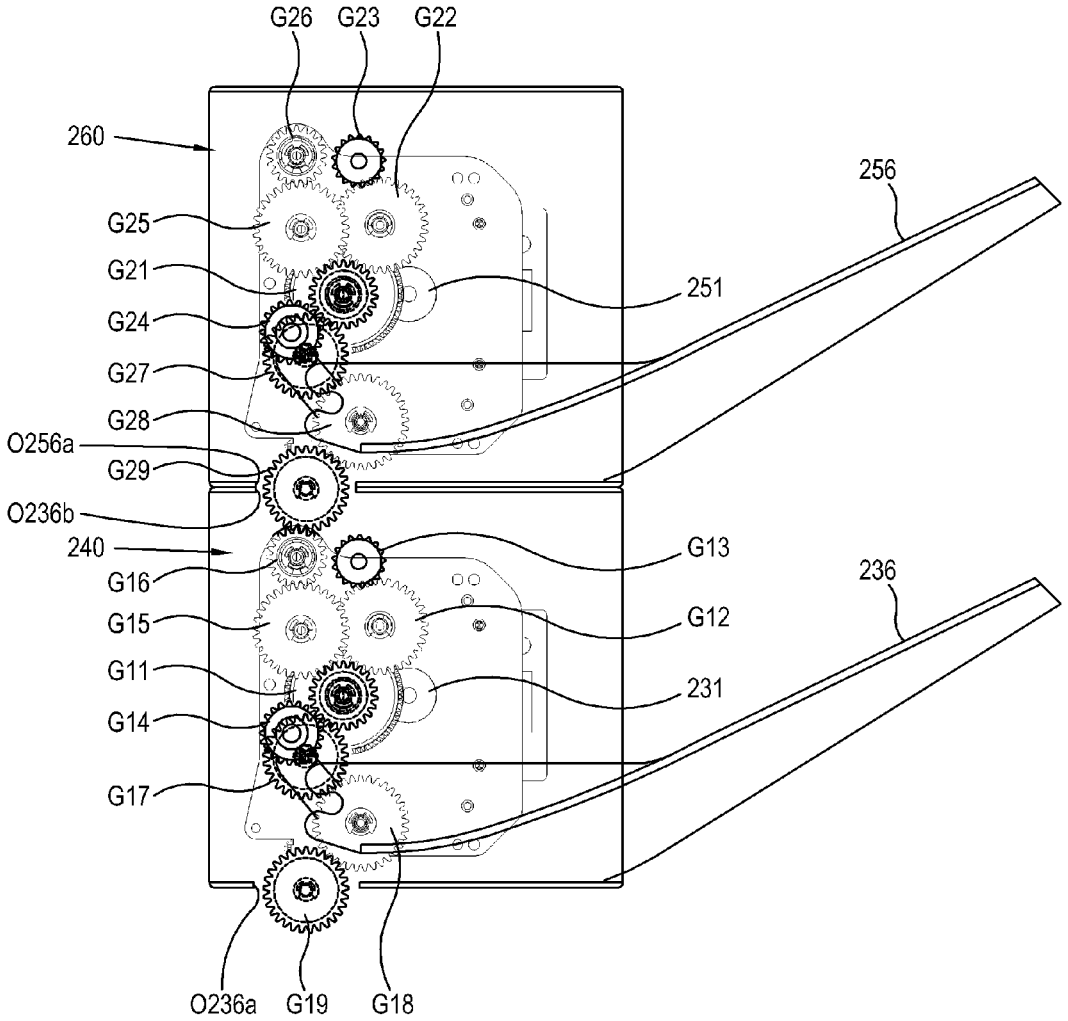
FIG. 2 is a schematic sectional view illustrating first and second auxiliary storing units in a storing apparatus according to an exemplary embodiment of the present general inventive concept.
Figure 3:
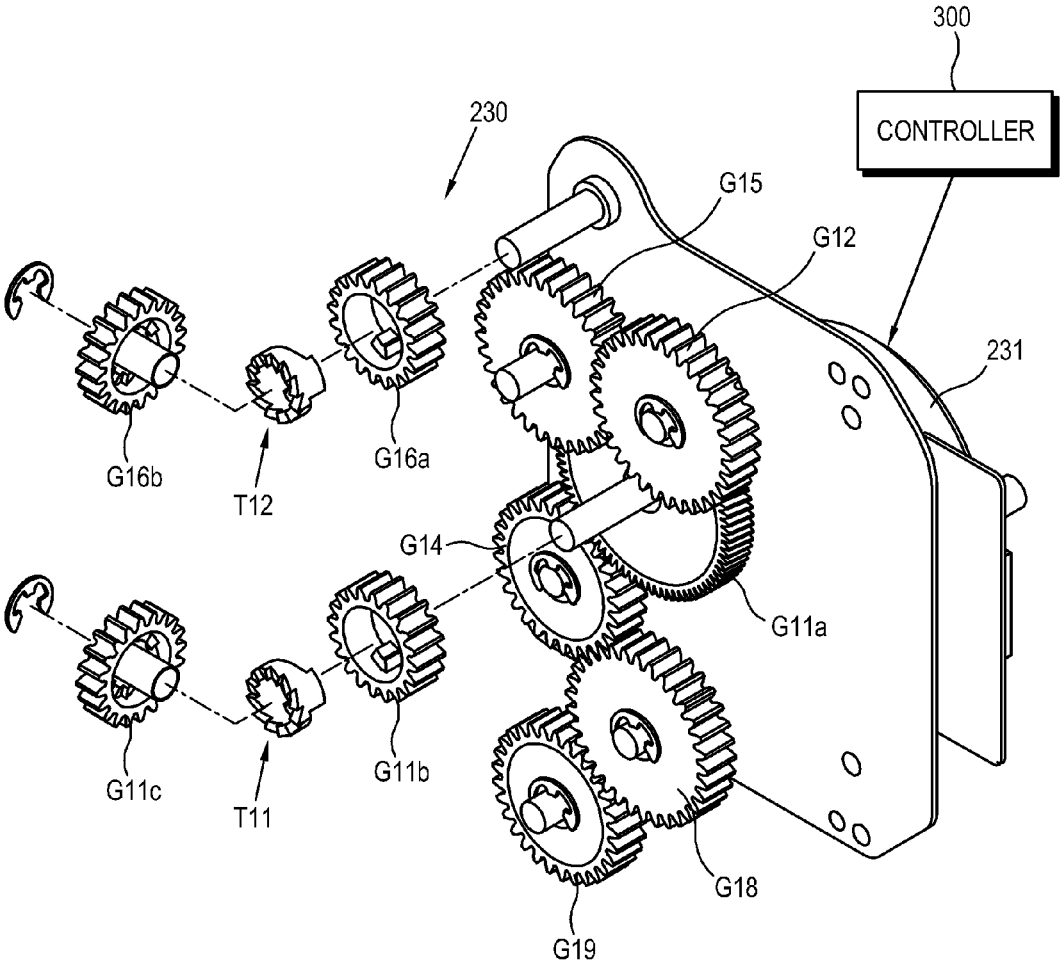
FIG. 3 is an exploded perspective view illustrating a main part of the first auxiliary storing unit in FIG. 2.

FIG. 2 schematically illustrates a sectional view of the first and second auxiliary storing units 230 and 250 of the storing apparatus according to the present embodiment, and FIG. 3 illustrates an exploded perspective view of a main part of the first auxiliary storing unit 230.

Referring to FIGS. 1 to 5, the first auxiliary storing unit 230 may include a first driving source 231 which is controlled by the controller 300, a second feeding unit 233 which may feed the print-medium discharged from the fusing unit 180, a first power transmission unit 240 which may transmit a driving force to the second feeding unit 233, and a second tray 236 on which the print-medium fed through the second feeding unit 233 is stored. The second feeding unit 233 includes second feeding rollers 234 which feed the print-medium M, and second discharging rollers 235 which discharge the print-medium M fed through the second feeding rollers 234 to the second tray 236.

As illustrated in FIG. 2, the gear G19 may be exposed and interconnected to the main storing unit 210 via an opening O236*a* in the first power transmission unit 240. Similarly, the gear G29 may be provided within two separate openings O236*b* and O256*a* provided in the first power transmission unit 240 and the second power transmission unit 260 respectively.

The first power transmission unit 240 includes a plurality of gears G11 to G19 which transmits a driving force, and may include first and second power switching units T11 and T12. The first power switching unit T11 transmits a driving force of the first driving source 231 to the plurality of gears G11 to G19 and the second feeding unit 233, and prevents a driving force of a second driving source 251 of the second auxiliary storing unit 250 from being transmitted to the second discharging rollers 235. The second power switching unit T12 transmits the driving force of the second driving source 251 to the second feeding rollers 234, and prevents the driving force from the first auxiliary storing unit 230 from being transmitted to the second auxiliary storing unit 250. Thereby, if a second sensor unit 237 detects that the second tray 236 has reached a certain capacity, or if a user selects a third tray 256, the print media-M may be transferred to third tray 256, bypassing second tray 236.

The first and second power switching units T11 and T12 may be of a clutch type, respectively, as illustrated in FIG. 3. For example, the second power switching unit T12 may include a pair of toothed elements which are provided opposite to each other on a gear shaft and engaged in a rotational direction and released in an opposite rotational direction.

Further, the first auxiliary storing unit 230 may include a second sensor unit 237 which senses the amount of the print-mediums stored on the second tray 236, and a second selector 239 through which a tray on which the print-medium is to be stored is selected according to the amount of the print-mediums sensed by the second sensor unit 237 or user selection.

The second auxiliary storing unit 250 includes the second driving source 251 which is controlled by the controller 300, a third feeding unit 253 which feeds the print-medium discharged from the fusing unit 180, a second power transmission unit 260 which transmits a driving force to the third feeding unit 253, and a third tray 256 on which the print-medium fed through the third feeding unit 253 is stored. The third feeding unit 253 includes third feeding rollers 254 which feed the print-medium, and third discharging rollers 255 which discharge the print-medium fed through the third feeding rollers 254 to the third tray 256.

Figure 5:
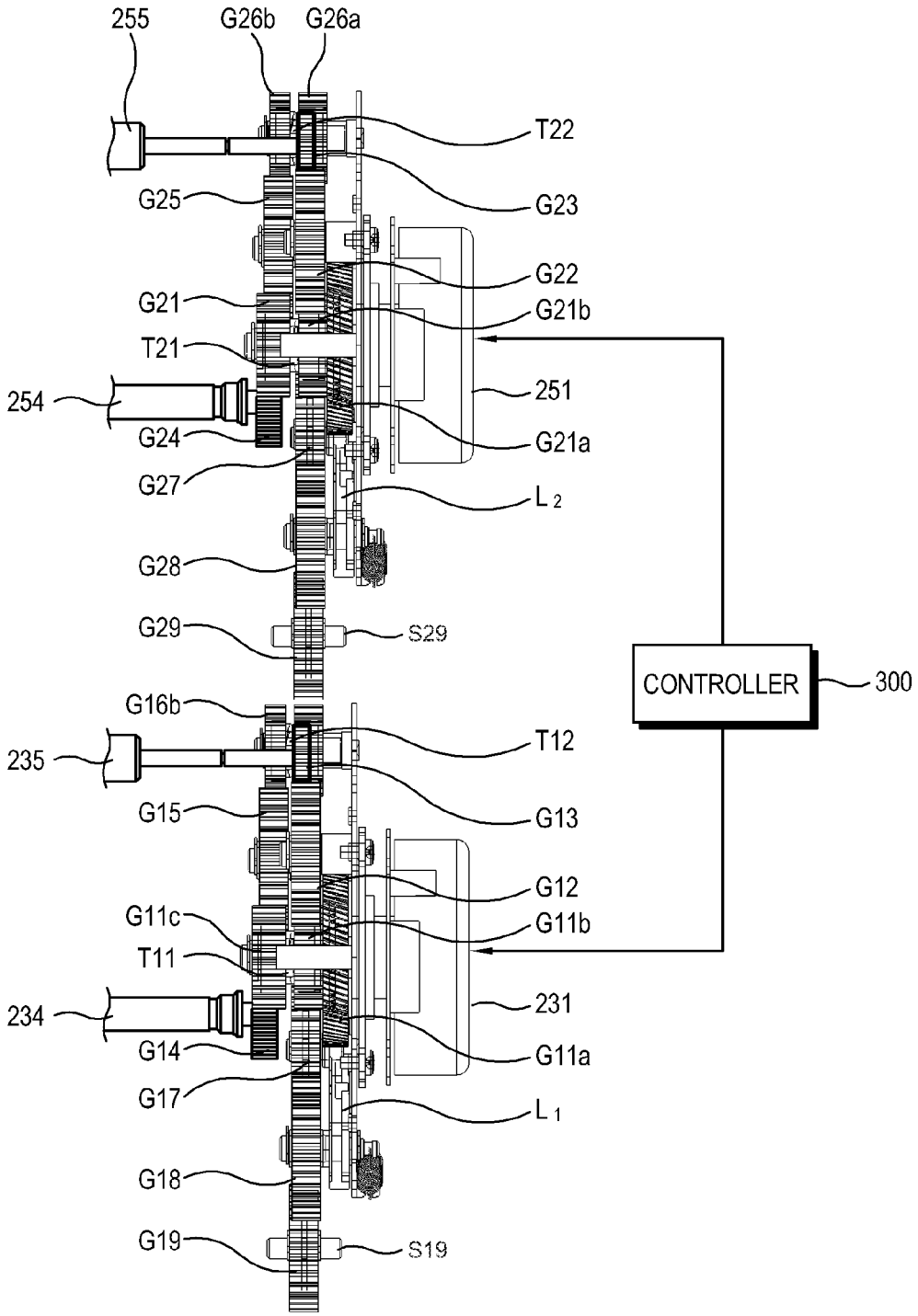
FIG. 5 is a front view illustrating the main part of the first and second auxiliary storing units in FIG. 2 in the case that a print-medium is discharged to the third tray of the second auxiliary storing unit.

The second power transmission unit 260 includes a plurality of gears G21 to G29 which transmits a driving force, and third and fourth power switching units T21 and T22 (illustrated in FIG. 5). The third power switching unit T21 may transmit the driving force of the second driving source 251 to the plurality of gears G21 to G29 and the third feeding unit 253. If a third auxiliary storing unit (not illustrated) is arranged upwards in addition to the second auxiliary storing unit 250, the third power switching unit T21 may prevent a driving force of a driving source of the third auxiliary storing unit from being transmitted to the third discharging rollers 255. The fourth power switching unit T22 may transmit the driving force of the third driving source (not illustrated) to the third feeding rollers 254, and may prevent the driving force from the second auxiliary storing unit 250 from being transmitted to the third auxiliary storing unit (not illustrated). Thus, when a printing medium M is being transmitted to a single storage tray, a driving force is only sent to the desired destination auxiliary storing unit.

Thus, the third power switching unit T21 may transmit the driving force of the second driving source 251 to the plurality of gears G21 to G29 and the third feeding unit 253 when a print-medium M is directed to be discharged to the third tray 256 of the second auxiliary storing unit 250. If a print medium is to be discharged to the third auxiliary storing unit, the third power switching unit T21 may prevent a driving force of a driving source of the third auxiliary storing unit from being transmitted to the third discharging rollers 255.

Further, the second auxiliary storing unit 250 may include a third sensor unit 257 mounted on a sub-housing 250*a* which senses the amount of print-mediums stored on the third tray 256, and a third selector 259 through which a tray on which the print-medium is to be stored is selected according to the amount of the print-mediums sensed by the third sensor unit 257 or user selection.

Hereinafter, operation of the print-medium storing unit according to the present embodiment will be described referring to FIGS. 3 to 8.

Figure 4:
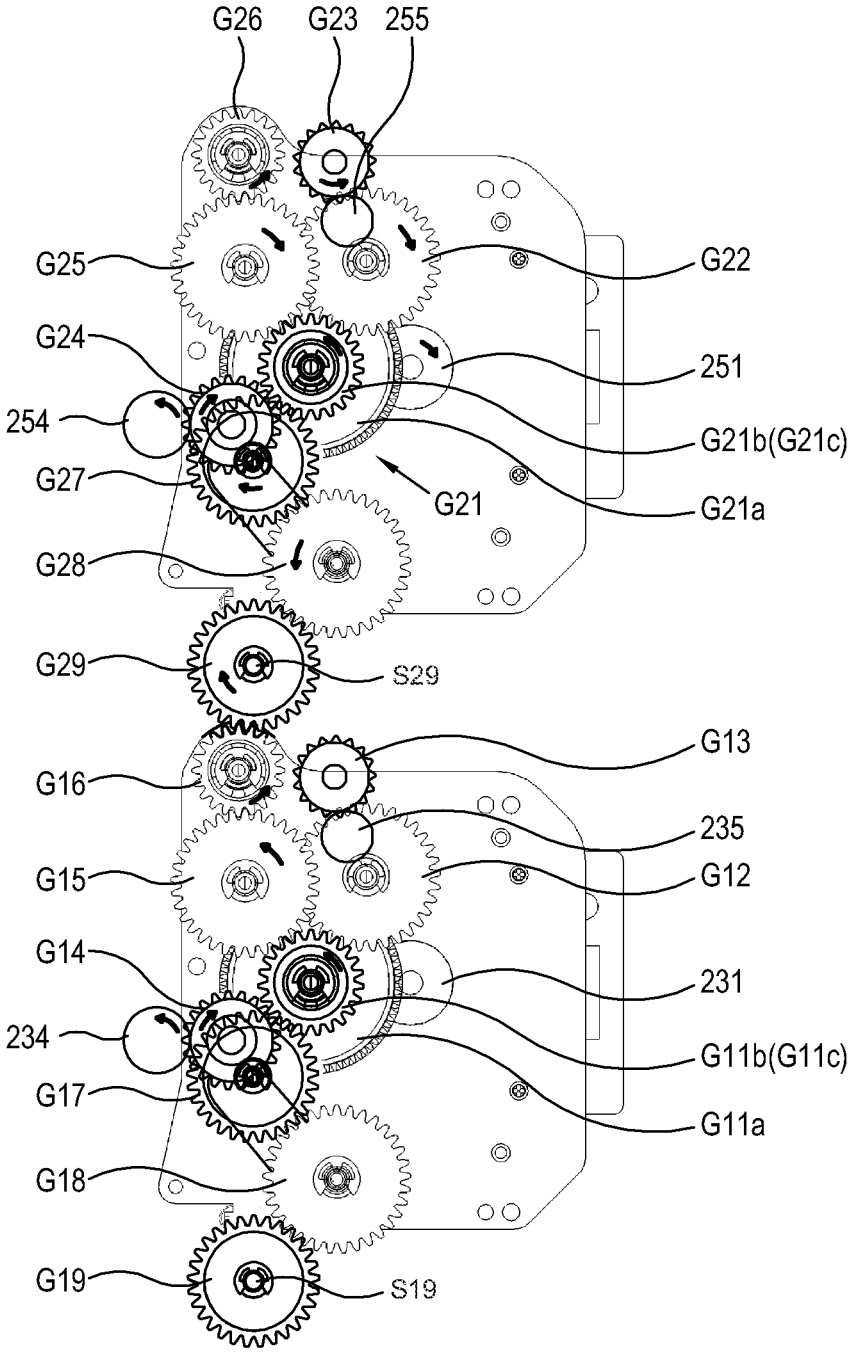
FIG. 4 is a side view illustrating a main part of the first and second auxiliary storing units in FIG. 2 in the case that a print-medium is discharged to a third tray of the second auxiliary storing unit.
Figure 6:
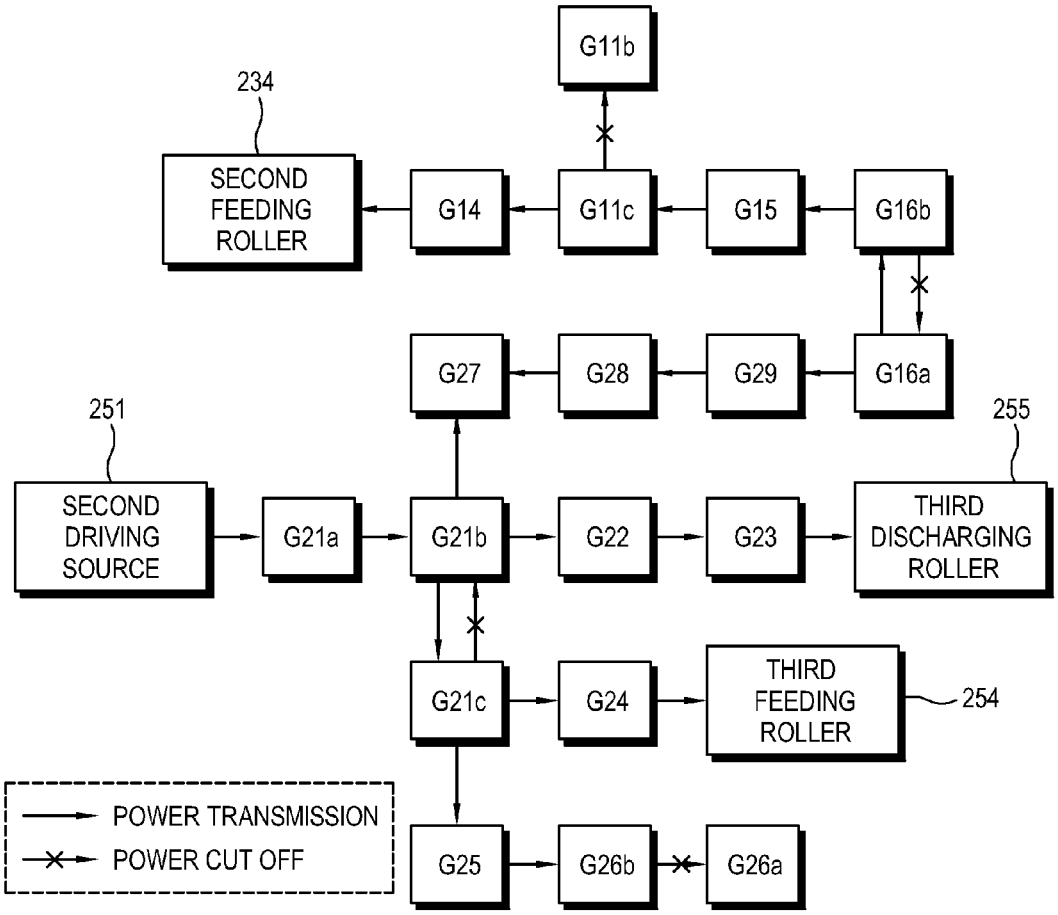
FIG. 6 is a block diagram illustrating a power transmission process of the storing unit in the case that a print-medium is discharged to the third tray of the second auxiliary storing unit.

FIGS. 4 to 6 illustrate the case that the print-medium is discharged to the third tray 256 of the second auxiliary storing unit.

Referring to FIGS. 1 and 3 to 6, when the print-medium is discharged to the second auxiliary storing unit 250 which includes the third tray 256, the second feeding rollers 234 of the first auxiliary storing unit 230 are driven by the driving force of the second driving source 251. That is, as electric power is supplied to the second driving source 251, the driving force of the second driving source 251 is transmitted to the gear unit G21. The gear unit G21 has a three-layered structure, in which a first gear layer G21*a* is engaged with the second driving source 251, and a second gear layer G21*b* is engaged with the gear G22. Accordingly, torque of the gear unit G21 rotates the third discharging rollers 255 through the gear G23 arranged on the same shaft as the third discharging rollers 255 and engaged with the gear G22.

The third power switching unit T21 of a clutch type is arranged between the second layer gear G21*b* and a third layer gear G21*c* of the gear unit G21 to transmit torque from the second layer gear G21*b* to the third layer gear G21*c*. However, the third power switching unit T21 prevents torque of the third layer gear G21*c* from being transmitted to the second layer gear G21*b*. In this respect, since configuration and operation of the third power switching unit T21 is known in the art, its description will be omitted. The torque transmitted to the third gear layer G21*c* of the gear unit G21 is transmitted to the gear G24 to drive the third feeding rollers 254.

Further, torque of the second layer gear G21*b* is transmitted to the gears G27, G28 and G29 which are sequentially engaged with the second layer gear G21*b*. In the case that the second layer gear G21*b* is engaged with the gear G27, the driving force of the second driving source 251 is transmitted to the second feeding rollers 234 of the first auxiliary storing unit 230. However, driving forces of other driving sources of the third auxiliary and additional storing units (not illustrated) provided above the second auxiliary storing unit 250 may be cut off by the third power switching unit T21, and thus, may not be transmitted to the first auxiliary storing unit 230. In this respect, the gear G27 may be designed to be engaged with the third layer gear G21*c* instead of the second layer gear G21*b*, in consideration of the multi-layered configuration of three layers or more.

Further, a rotational shaft of the gear G28 may be connected to a rotational shaft of the gear G27 through a link L2. The link L2 may rotationally move around the rotational shaft of the gear G27. Accordingly, torque may be transmitted or cut off between the gear G28 and the gear G29 according to a rotational position of the link L2. FIG. 4 illustrates a state that the gear G28 is engaged with the gear G29.

The gear G29 may be engaged with a first layer gear G16*a* (illustrated in FIG. 6) of the gear unit G16 in which the second power switching unit T12 is arranged on the same shaft. In this respect, the second power switching unit T12 of a clutch type is arranged between the first layer gear G16*a* and a second layer gear G16*b* of the gear unit G16. Accordingly, the second power switching unit T12 transmits torque from the first layer gear G16*a* to the second layer gear G16*b*, but prevents torque of the second layer gear G16*b* from being transmitted to the first layer gear G16*a*. Accordingly, the second power switching unit T12 may transmit torque from the second auxiliary storing unit 250 to the first auxiliary storing unit 230, and may prevent torque of the first auxiliary storing unit 230 from being transmitted to the second auxiliary storing unit 250.

The torque transmitted to the second layer gear G16*b* of the gear unit G16 is sequentially transmitted to the gears G15, G11*c* and G14 to drive the second feeding rollers 234. In this respect, the first power switching unit T11 is arranged between a second layer gear G11*b* and a third layer gear G11*c* of the gear unit G11 to prevent torque of the third layer gear G11*c* from being transmitted to the second layer gear G11*b*. Accordingly, the second discharging rollers 235, the gears G17, G18 and G19, to which torque is transmitted from the second layer gear G11*b*, may not be rotated.

In this respect, in order to realize storing units of three layers or more having the same shape, the gear G17 may be designed to be engaged with the third layer gear G11*c*. In this case, torque of the gear unit G16 may be transmitted to the gears G17 and G18. In this respect, the gear G18 may be released from the gear G19 according to a rotational position of a link L1, and thus, the gear G19 does not rotate.

The gear G25 may be engaged with a third layer gear G21*c* of the gear unit G21 and a second layer gear G26*b* of the gear unit G26, respectively. In this respect, the fourth power switching unit T22 of a clutch type may be arranged between the first layer gear G26*a* and the second gear G26*b* of the gear unit G26 to prevent torque of the second layer gear G26*b* from being transmitted to the first layer gear G26*a*. Accordingly, the fourth power switching unit T22 prevents torque of the second auxiliary storing unit 250 from being transmitted to additional storing units or to the upside of the second auxiliary storing unit 250.

The first feeding rollers 212 of the main storing unit 210 may be independently driven by a separate main driving source (not illustrated) arranged in the image forming apparatus.

As described above, in the case that a print-medium is to be discharged onto the third tray 256 by driving the second driving source 251, torque may be transmitted to the second and third feeding rollers 234 and 254, and the third discharging rollers 255, but is not transmitted to the second discharging rollers 235 as illustrated in FIG. 6. Accordingly, the print-medium can be discharged to the third tray 256 without driving the first driving source 231. In this way, torque is not transmitted to the second discharging rollers 235 which does not relate to feeding of the print-medium, thereby reducing power consumption.

Figure 7:
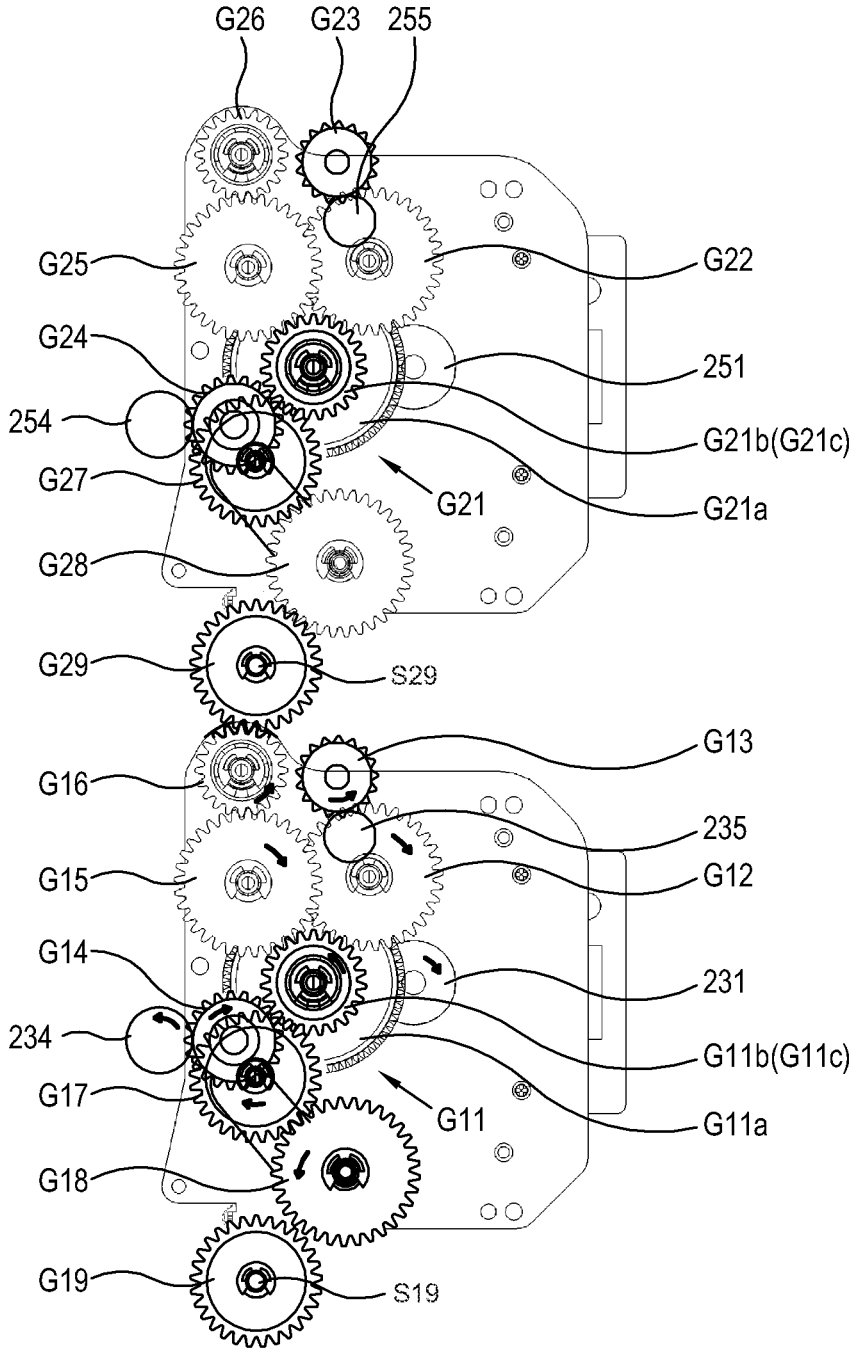
FIG. 7 is a side view illustrating the main part of the first and second auxiliary storing units in the case that a print-medium is discharged to a second tray of the first auxiliary storing unit.
Figure 8:
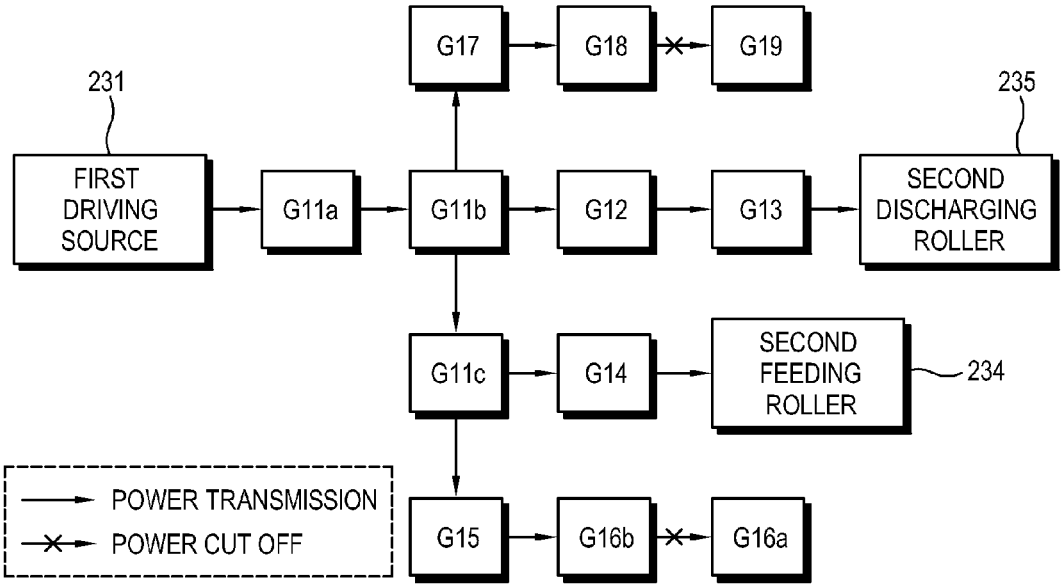
FIG. 8 is a block diagram illustrating a power transmission process of the storing unit in the case that a print-medium is discharged to the second tray of the first auxiliary storing unit.

FIG. 7 and FIG. 8 illustrate the case that the print-medium is discharged to the second tray 236 of the first auxiliary storing unit 230.

Referring to FIGS. 7 and 8, when the print-medium is discharged to the second tray 236, the first power transmission unit 240 (illustrated in FIG. 2) is driven by the driving force of the first driving source 231. That is, according as electric power is applied to the first driving source 231, the driving force of the first driving source 231 is transmitted to the gear unit G11. The gear unit G11 has three layers, in which the first layer gear G11*a* is engaged with the second driving source 231 and the second layer gear G11*b* is engaged with the gear G12. Accordingly, torque of the gear unit G11 is transmitted to the gear G12 to rotate the second discharging rollers 235 through the gear G13 arranged on the same shaft as the second discharging roller 235.

Torque transmitted to the third layer gear G11*c* of the gear unit G11 is transmitted to the gear G14 to drive the second feeding rollers 234.

Torque of the second layer gear G11*b* is transmitted to the gears G17 and G18 which are sequentially engaged with the second layer gear G11*b*. In this respect, the gears G18 and G19 are released from each other as illustrated in FIG. 7. Accordingly, torque may not be transmitted to the main storing unit through the gear G19.

Further, the gear G15 may be respectively engaged with the third layer gear G11*c* of the gear unit G11 and the second layer gear G16*b* of the gear unit G16. In this respect, the second power switching unit T12 (illustrated in FIG. 5) of a clutch type may be arranged between the first layer gear G16*a* and the second layer gear G16*b* of the gear unit G16 to prevent torque of the second layer gear G16*b* from being transmitted to the first layer gear G16*a*. Accordingly, the second power switching unit T12 may prevent torque of the first auxiliary storing unit 230 from being transmitted to the second auxiliary storing unit 250.

As described above, in the case that the print-medium is discharged to the second tray 236 by driving the first driving source 231, torque may be transmitted to the second discharging rollers 235 and the second feeding rollers 234, but may not be transmitted to the second auxiliary storing unit 250, as illustrated in FIG. 8.

In another exemplary embodiment, when the print-medium M is discharged to the second tray 236, the gear G29 may be disengaged from interlocking contact with upper gear G28 associated with the third feeding roller 254 and lower gear G16. This disengagement may serve to limit the power consumption of the image forming apparatus by limiting rotating power to gears G11 to G19 of the first power transmission unit 240, and preventing the rotation, and thus power consumption by engagement of gears G21 to G29. In other situations where the print medium must be sent to an upper auxiliary storing unit, the gear G29 may be re-engaged to connect to the upper gears.

Similarly, when the print-medium M is discharged to the main storing unit, the gear G19 may be disengaged from interlocking contact with upper gear G18, and the auxiliary storing unit 230. The disengagement of gears G29 and G19 may be implemented through the use of elongated gear shafts S29 and S19 to allow the gears G29 and G19 to be shifted along the axis direction of the shafts S29 and S19 to a position in which the gears G29 and G19 are not in physical interlocking contact with adjacent gears. The disengagement and re-engagement of the gears G29 and G19 may be automatically controlled by the controller 300 in a power-save mode, as a default setting, or when directed by a user.

In the present embodiment, the first and second auxiliary storing units 230 and 250 are arranged as two-layers (trays) above the main storing unit 210, but three or more auxiliary storing units may be arranged with three or more layers (trays) to store a print medium M. Further, the first auxiliary storing unit 230 and the second auxiliary storing unit 250 may have the same configuration in the present embodiment, but also may have different configurations. Furthermore, positions of the links L1 and L2 may vary according to positions of the auxiliary storing units.

As described above, according to the print-medium storing unit and apparatus and the image forming apparatus including the same, although electric power may be applied to the driving source of the auxiliary storing unit through which the print-medium is stored and the driving source of the main storing unit, all the feeding rollers on a feeding path of the print-medium can be driven. Accordingly, power supply is cut off to the driving source of another auxiliary storing unit, and thus, the discharging rollers of another auxiliary storing unit and the plurality of gears which transmits the driving force of the driving source to the discharging rollers of another auxiliary storing unit do not rotate, thereby reducing power consumption and noises.

As described above, according to the print-medium storing unit and apparatus and the image forming apparatus including the same, all the feeding rollers on the feeding path of a print-medium may be rotated by a driving force of a driving source connected to a storing unit in which the print-medium is stored, thereby feeding the print-medium without driving all the driving sources of the storing units, thereby reducing power consumption and noises due to the driving of the driving source.

Although a few exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus with a plurality of storing units, comprising:

a main storing unit formed in the an image forming apparatus;

first and second auxiliary storing units above the main storing unit comprising respective first and second power transmission units disposed in the first and second auxiliary storing units and respective first and second feeding rollers, the first power transmission unit being arranged to prevent torque such that discharging rollers of the first auxiliary storing unit are not rotated when a print medium is discharged into a storage area of the second auxiliary storing unit, wherein the first feeding rollers of the first auxiliary storing unit are driven via a first gear mounted on a shaft thereof by a driving force of a driving source of the second power transmission unit and a driving force of the first auxiliary storing unit is prevented from being transmitted from a second gear mounted on the shaft to the first gear and to the second auxiliary storing unit.

2. The image forming apparatus of claim 1, further comprising:

a gear unit with a three-layered structure that generates a torque to rotate discharging rollers in the second auxiliary storing unit.

3. The image forming apparatus of claim 2, wherein torque of the second power transmission unit is transmitted to the gear unit and drives the rotation of the second feeding rollers.

4. The image forming apparatus of claim 1, wherein the second power transmission unit transmits torque from the second auxiliary storing unit to the first auxiliary storing unit.

5. The image forming apparatus of claim 1, wherein the first and second auxiliary storing units are detachably attached to the main storing unit.

6. The image forming apparatus of claim 1, wherein the first and second auxiliary storing units are disposed above the main storing unit and are stationary with respect to the main storing unit.

7. The image forming apparatus of claim 1, wherein each auxiliary storing unit further comprises:

a feeding unit which feeds the print-medium;

a tray on which the print-medium fed through the feeding unit is stored;

a sensor unit which senses the amount of the print-mediums stored on the tray; and a selector through which a tray on which the print-medium is to be stored is selected according to the amount of the print-mediums sensed by the sensor unit or user selection.

* * * * *

UNITED STATES PATENT AND TRADEMARK OFFICE

CERTIFICATE OF CORRECTION

PATENT NO. : 9,022,387 B2
APPLICATION NO. : 14/086058
DATED : May 5, 2015
INVENTOR(S) : Joo-heon Lee It is certified that error appears in the above-identified patent and that said Letters Patent is hereby corrected as shown below:

In the claims

Claim 1, Column 12, Line 36

After “formed in” delete “the”.

Signed and Sealed this
Thirteenth Day of October, 2015

Michelle K. Lee

Michelle K. Lee
*Director of the United States Patent and Trademark Office*